US007430885B2

(12) United States Patent
Maeda et al.

(10) Patent No.: US 7,430,885 B2
(45) Date of Patent: Oct. 7, 2008

(54) DRUM TYPE WASHING MACHINE WITH ANGLED DOOR OPENING

(75) Inventors: Satoshi Maeda, Osaka (JP); Hiroshi Kajihara, Hyogo (JP); Kazunori Maeda, Nara (JP); Tadashi Inuzuka, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 584 days.

(21) Appl. No.: 11/107,879

(22) Filed: Apr. 18, 2005

(65) Prior Publication Data

US 2006/0053844 A1 Mar. 16, 2006

(30) Foreign Application Priority Data

Sep. 13, 2004 (JP) ..... 2004-265112

(51) Int. Cl.
*D06F 37/04* (2006.01)
*D06F 37/10* (2006.01)

(52) U.S. Cl. ..... 68/24; 68/58; 68/139; 68/196

(58) Field of Classification Search ..... 68/24, 68/58, 139, 196
See application file for complete search history.

(56) References Cited

U.S. PATENT DOCUMENTS 2,424,737 A * 7/1947 Broglie ..... 34/82
2,500,062 A * 3/1950 Clark ..... 34/139
2,899,816 A * 8/1959 Jacobsen, Jr. ..... 68/20
5,881,579 A * 3/1999 Ellingson ..... 68/24
6,539,753 B1 4/2003 Ito et al.
7,073,356 B2 7/2006 Nakamura et al.
2002/0002847 A1 1/2002 Son et al.
2003/0051514 A1 3/2003 Kim et al.

FOREIGN PATENT DOCUMENTS

| | | |
|---|---|---|
| CN | 1185382 C | 1/2005 |
| EP | 1116812 | 7/2001 |
| FR | 2736942 | 1/1997 |
| JP | 2004-195100 | 7/2004 |
| KR | 2002-0091795 | 12/2002 |

OTHER PUBLICATIONS

XML Module, http://web.archive.org/web/20040617070431/doc.trolltech.com/3.3/xml.html; Trolltech, Jan. 2004, 10 pgs.

* cited by examiner

*Primary Examiner*—Joseph L Perrin
(74) *Attorney, Agent, or Firm*—Bacon & Thomas, PLLC

(57) ABSTRACT

A drum type washing machine includes a housing, a rotary drum, a water tub accommodating the rotary drum therein, a door for opening and closing a housing opening for allowing laundry to be loaded into or unloaded from the rotary drum therethrough, a water tub opening communicating with the housing opening, a rotary drum opening communicating with the housing opening and the water tub opening; and an elastic connection member for connecting the housing opening and water tub opening, and having a portion that makes a pressurized contact with the door when the door is closed. A center of the housing opening is displaced upward with respect to a center of the rotary drum opening, and an angle of inclination of the housing opening with respect to a vertical plane is set to be greater than that of the rotary drum opening with respect to the vertical plane.

2 Claims, 3 Drawing Sheets

DRUM TYPE WASHING MACHINE WITH ANGLED DOOR OPENING

FIELD OF THE INVENTION

The present invention relates to a drum type washing machine for washing laundry accommodated in a rotary drum by rotating the rotary drum disposed in a water tub.

BACKGROUND OF THE INVENTION

A conventional drum type washing machine is shown in FIG. 3 (see, for example, Japanese Patent Laid-Open Application No. 2004-195100). Hereinafter, a configuration thereof will be described.

As shown in FIG. 3, rotary drum 1 provided with multiple drum perforations 2 in its cylindrical surface is rotatably installed in water tub 5 supported by suspension structure 4 within housing 3. Rotary drum 1 is also provided with rotating shaft (central shaft of rotation) 6 at its center of rotation and is disposed such that rotating shaft 6 is upwardly inclined toward the front portion of the washing machine. Motor 7 is connected to rotating shaft 6 to make rotary drum 1 rotate. Further, a number of agitation blades 8 are disposed on the inner cylindrical surface of rotary drum 1.

Further, by opening door 9, which is installed at the front portion of housing 3 such that it can be freely opened and closed, laundry can be loaded into or unloaded from rotary drum 1 via housing opening 3*a*, water tub opening 5*a* and rotary drum opening 1*a* formed at housing 3, water tub 5 and rotary drum 1, respectively.

Moreover, respective centers of housing opening 3*a*, water tub opening 5*a* and rotary drum opening 1*a* are arranged such that they lie on a substantially same line, namely, on a central axis of rotation of rotating shaft 6. Further, respective inclination angles of housing opening 3*a*, water tub opening 5*a* and rotary drum opening 1*a* with respect to a vertical plane are set to be virtually identical.

When the operation of the drum type washing machine is initiated after laundry being loaded into rotary drum 1 through opening door 9 and detergent being added thereto, a predetermined amount of water is supplied in water tub 5 via water supply valve 10 and a portion thereof flows into rotary drum 1 through drum perforations 2 as well. Then, when rotary drum 1 is driven to rotate at a predetermined rotational speed by motor 7, the laundry in rotary drum 1 is lifted up in the rotational direction by agitation blades 8 disposed on the inner cylindrical surface of rotary drum 1 and drops down upon reaching a specific height, thereby undergoing pounding motions to be washed. After completion of the washing process, soiled wash water is drained via water drain valve 11, and a rinsing process is carried out in fresh water. Then, when the rinsing process is finished, a water-extracting process for spinning rotary drum 1 at a high rotational speed is executed. The series of processes described are automatically performed in accordance with a preset control sequence stored in controller 12.

With the above-described configuration, user can easily see the inside of rotary drum 1 from above in the drum type washing machine in comparison with a drum type washing machine with a housing opening, a water tub opening and a rotary drum opening provided in a vertical direction. Further, loading and unloading of the laundry into and from rotary drum 1 can be performed more conveniently.

Since housing opening 3*a*, water tub opening 5*a* and rotary drum opening 1*a* are arranged concentrically to thereby have respective centers thereof substantially on the central axis of rotation of rotary drum 1 and the respective inclination angles of housing opening 3*a*, water tub opening 5*a* and rotary drum opening 1*a* with respect to the vertical plane are set to be substantially same, there is a blind spot in the front portion of rotary drum 1, i.e., a space that cannot be directly observed, when door 9 is opened. Therefore, a user may fail to spot any laundry in the space, thereby failing to pick up the laundry. Further, in order to ameliorate the inconvenience of the user having to bend down a lot to load and unload laundry into and out of rotary drum 1, the housing opening 3*a*'s angle of inclination needs to be set large. To this end, it is required that a depth dimension of housing 3 becomes increased, but there is a limit thereto as well. For this reason, the size of the angle of inclination of housing opening 3*a* should be limited within a specific range to be accommodated within the limited depth dimension of housing 3.

SUMMARY OF THE INVENTION

It is, therefore, an object of the present invention to provide a drum type washing machine capable of facilitating loading and unloading of laundry into and out of a rotary drum while maximally reducing a depth dimension of a housing, and decreasing a blind spot area within the rotary drum.

In accordance with a preferred embodiment of the present invention, there is provided a drum type washing machine including: a housing; a rotary drum having a rotational axis declined toward a rear portion of the housing; a water tub elastically supported in the housing and accommodating the rotary drum therein; a door installed at a front portion of the housing, for opening and closing a housing opening for allowing laundry to be loaded into or unloaded from the rotary drum therethrough; a water tub opening formed at the water tub and communicating with the housing opening; a rotary drum opening formed at the rotary drum and communicating with the housing opening and the water tub opening; and an elastic connection member for connecting the housing opening and water tub opening, and having a portion that makes a pressurized contact with the door when the door is closed, wherein a center of the housing opening is displaced upward with respect to a center of the rotary drum opening, and an angle of inclination of the housing opening with respect to a vertical plane is set to be greater than that of the rotary drum opening with respect to the vertical plane.

BRIEF DESCRIPTION OF THE DRAWINGS

The above and other objects and features of the present invention will become apparent from the following description of preferred embodiment given in conjunction with the accompanying drawings, in which.

DETAILED DESCRIPTION OF THE PREFERRED EMBODIMENTS

Hereinafter, preferred embodiments of the present invention will be described with reference to the accompanying drawings. Here, it is to be noted that the present invention is not limited thereto.

Figure 1:
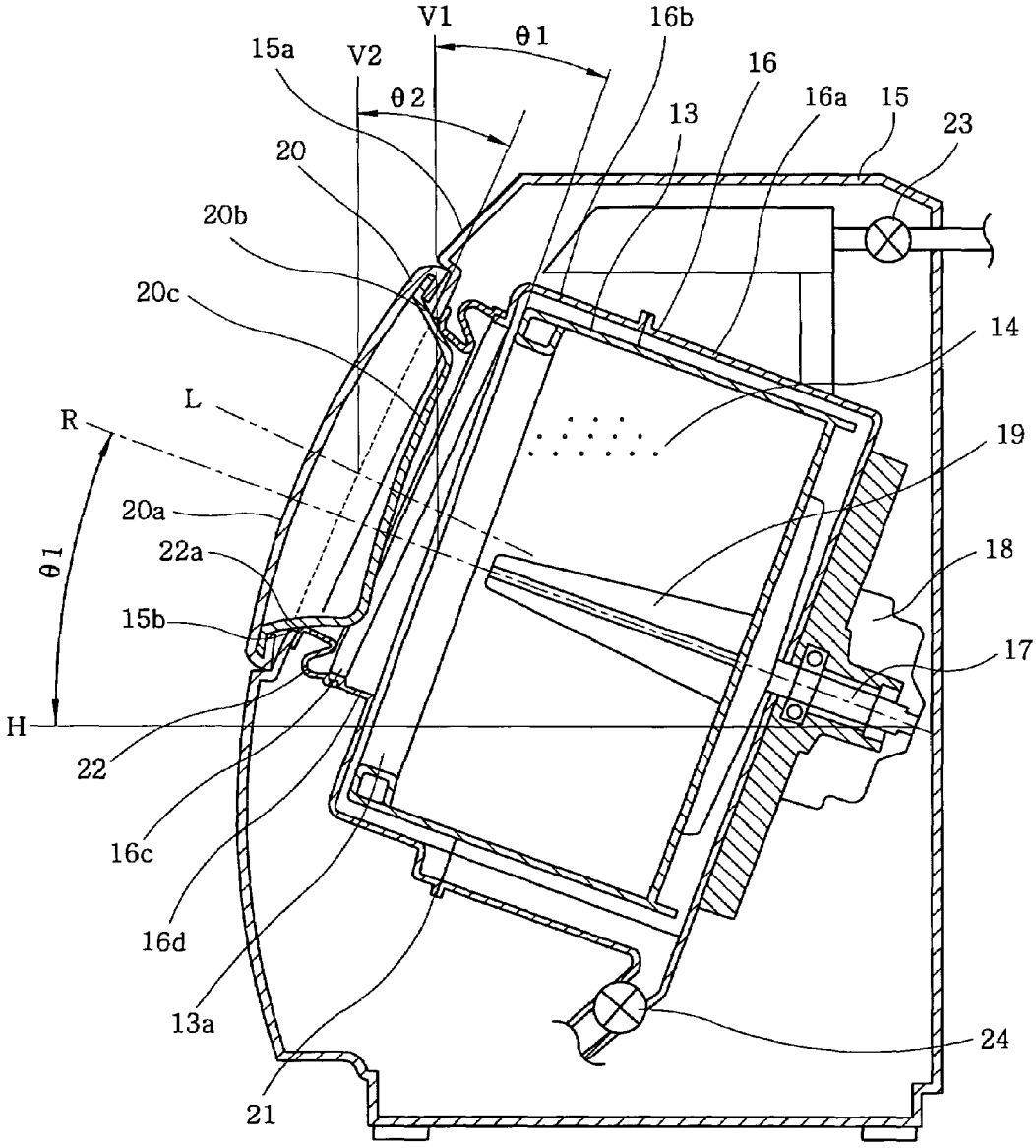
FIG. 1 is a vertical cross sectional view of a drum type washing machine in accordance with a preferred embodiment of the present invention.
Figure 2:
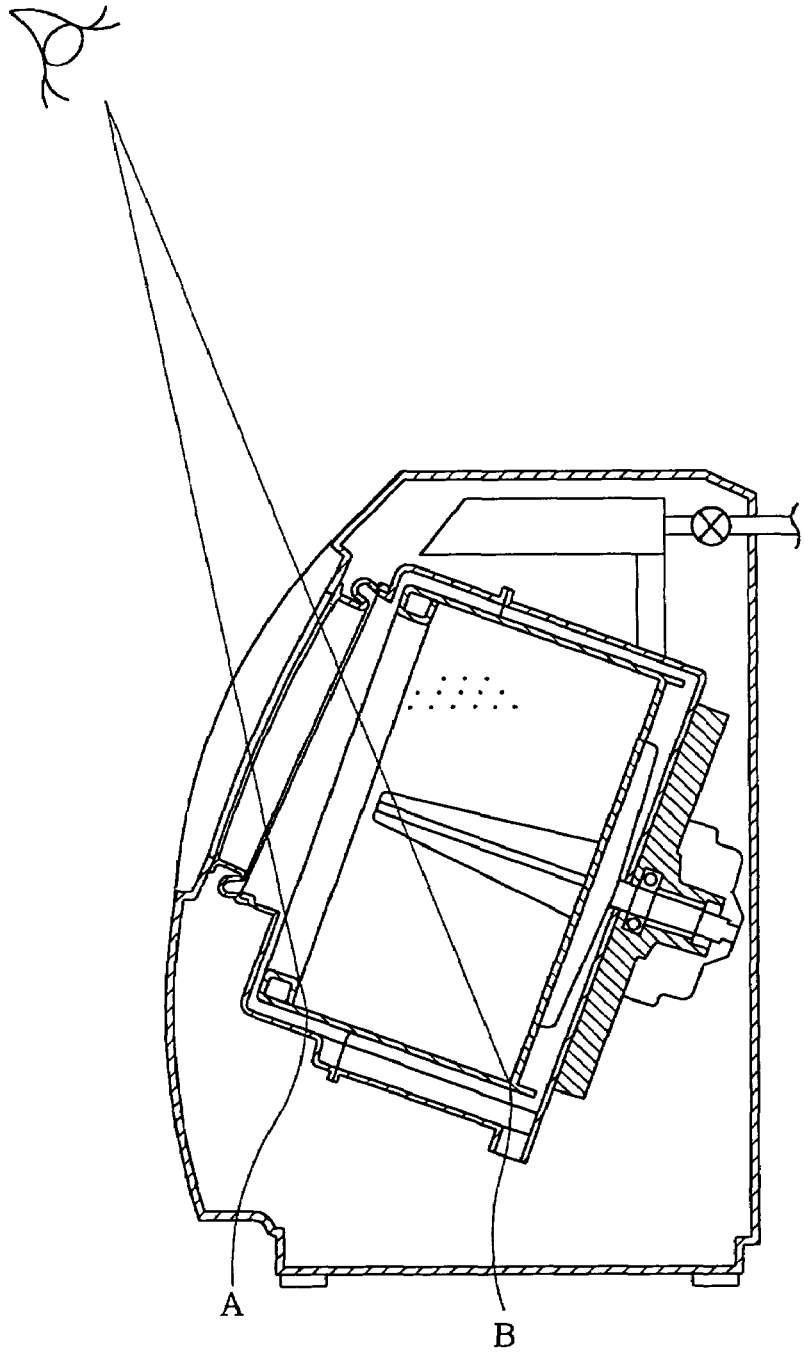
FIG. 2 presents a vertical cross sectional view of the drum type washing machine with its door opened.
Figure 3:
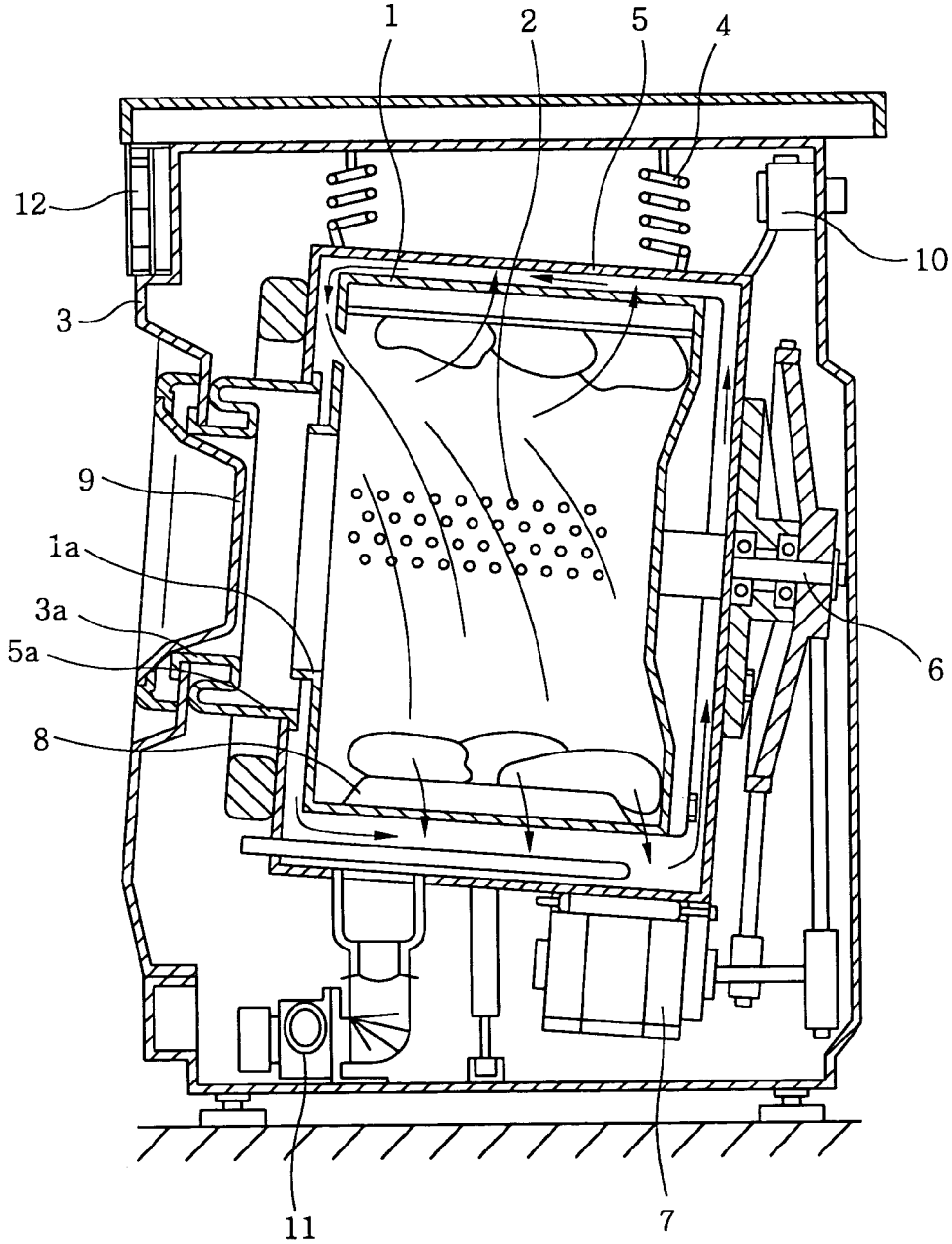
FIG.3 (PRIOR ART)
FIG. 3 sets forth a vertical cross sectional view of a conventional drum type washing machine.

FIG. 1 is a vertical cross sectional view of a drum type washing machine in accordance with a preferred embodiment of the present invention and FIG. 2 presents a vertical cross sectional view of same showing a state when its door is opened.

As shown in FIG. 1, rotary drum 13 provided with multiple drum perforations 14 in its cylindrical surface is rotatably disposed in water tub 16 supported by a suspension structure (not shown) within housing 15. Rotary drum 13 is also provided with rotating shaft (central shaft of rotation) 17 at its center of rotation and is disposed such that a central axis R of rotation of rotating shaft 17 is upwardly inclined toward the front portion of the washing machine. Motor 18 is connected to rotating shaft 17 to rotate rotary drum 13. Further, a number of agitation blades 19 are disposed on the inner cylindrical surface of rotary drum 13. The central axis R of rotation of rotating shaft 17 is slanted at a specified angle θ1 with respect to a horizontal plane H. In other words, rotary drum opening 13*a* provided at a front end portion of rotary drum 13 forms the angle of θ1 with respect to a vertical plane V1.

Further, housing 15 has inclined surface 15*a* formed at a front surface portion thereof, and housing opening 15*b*, which can be freely opened and closed with door 20, is formed at inclined surface 15*a*. Housing opening 15*b* forms an angle of θ2 with respect to a vertical plane V2 (which is parallel to V1). Here, θ2 is larger than θ1. Moreover, a center L of housing opening 15*b* is upwardly displaced from the central axis R of rotation of rotary drum 13's rotating shaft 17 by a specified amount.

Water tub 16 includes main body 16*a* and lid 16*b* that are connected to each other via sealing member 21. Lid 16*b* is provided with flange 16*d* that defines water tub opening 16*c* at its front portion. The flange 16*d* is formed in such a manner that its width is gradually increased starting from a top of water tub opening 16C and ending at a bottom thereof when viewed in FIG. 1. Accordingly, water tub opening 16*c* can be arranged to be virtually concentric with and substantially parallel to housing opening 15*b*.

Moreover, connection member 22 formed of a flexible elastic body is disposed between housing opening 15*b* and water tub opening 16*c* in order to prevent water from leaking into a bottom portion of housing 15 through a gap between housing opening 15*b* and water tub opening 16*c*. Further, when door 20 is closed, lip portion 22*a* of connection member 22 makes a pressurized contact with an inner surface of door 20, to thereby prevent splashed water by the rotation of rotary drum 13 from running over water tub 16.

Door 20 includes outer body 20*a* and inner body 20*b*. Outer body 20*a* is disposed to be substantially parallel to housing opening 15*b*. Meanwhile, inner body 20*b* of door 20 has substantially flat surface 20*c* which is positioned inside housing 15 and is substantially parallel to rotary drum opening 13*a* when door 20 is closed. Further, by forming outer body 20*a* and inner body 20*b* of door 20 partially or entirely with a transparent material, the inside of rotary drum 13 can be looked into from outside, thereby allowing a user to inspect the status of laundry in rotary drum 13.

Further, water supply valve 23 for supplying water into water tub 16 and water drain valve 24 for draining water from water tub 16 are installed in housing 15.

The operation of the drum type washing machine of the above-described configuration will now be described. First, door 20 is opened, laundry is loaded into rotary drum 13 through housing opening 15*b*, water tub opening 16*c* and rotary drum opening 13*a* and detergent is added thereto. Next, when the operation of the drum type washing machine is initiated, a predetermined amount of water is supplied in water tub 16 from water supply valve 23 and a portion thereof flows into rotary drum 13 through drum perforations 14 as well. Then, when rotary drum 13 is driven to rotate at a predetermined rotational speed by motor 18, laundry in rotary drum 13 is lifted up in the rotational direction by agitation blades 19 disposed on the inner cylindrical surface of rotary drum 13 and drops down upon reaching a specific height, thereby undergoing pounding motions to be washed. After completion of the washing process, soiled wash water is drained via water drain valve 24, and a rinsing process is carried out in fresh water. Then, when the rinsing process is finished, a water-extracting process for spinning rotary drum 13 at a high rotational speed is executed. The series of processes described are automatically performed in accordance with a preset control sequence stored in a controller (not shown).

The center L of housing opening 15*b* is located above the center R of rotary drum opening 13*a*, and the housing opening 15*b*'s angle θ2 of inclination with respect to the vertical plane V2 is set to be greater than the rotary drum opening 13*a*'s angle θ1 of inclination with respect to the vertical plane V1. Consequently, housing opening 15*b* is arranged such that its upper end portion is disposed above and closer to rotary drum opening 13*a*. Therefore, as shown in FIG. 2, both front bottom portion A and rear bottom portion B of rotary drum 13 can be easily sighted by a user without bending when the user looks into the inside of rotary drum 13 while standing in front of the washing machine. That is, the inner bottom portion of rotary drum 13 can be viewed more extensively. As a result, loading and unloading of laundry can be performed more conveniently, and it is highly unlikely that the user would fail to take out any laundry inside rotary drum 13 after the washing process is completed.

Since water tub opening 16*c* is disposed to be substantially concentric with and parallel to housing opening 15*b*, upper and lower end sections of connection member 22 need not be of different shapes, and are substantially concentric with water tub opening 16*c* or housing opening 15*c* and parallel to the central axis R. In other words, since the housing opening side of connection member 22 can be formed to be parallel to water tub opening 16*c*, the design and molding process of connection member 22 can be easily carried out and it is possible to improve reliability thereof.

If laundry is unbalanced toward one portion of rotary drum 13 during a water-extracting process, water tub 16 would vibrate considerably in every direction, and an excessive force generated due to the abnormal vibrations may cause connection member 22 to be broken or to be deformed or to develop a hole. Since, however, connection member 22 is formed such that its upper and lower end sections are of a substantially same shape while being substantially concentric with water tub opening 16*c* or housing opening 15*c* and parallel to the central axis R, abnormal deformation of connection member 22 due to the excessive force exerted thereon can be avoided, thereby improving durability.

Moreover, since substantially flat surface 20*c* of door 20's inner body 20*b* is disposed substantially in parallel to rotary drum opening 13*a*, a lower portion of substantially flat surface 20*c* is protruded more than an upper portion thereof. Thus, the lower portion of substantially flat surface 20*c* serves to push laundry loaded in rotary drum 13 into rotary drum 13, to thereby prevent the laundry from being laden on connection member 22 and also prevent connection member 22 from getting damaged due to the contact with the laundry.

Further, although the angle θ1 of inclination of rotary drum opening 13*a* is made small, the angle θ2 of inclination of housing opening 15*b* is set to be great. Therefore, by reducing the angle θ1, the inner dimension of housing 15 can be maintained small, while realizing the above-described effects of the present invention.

As described above, the drum type washing machine in accordance with the present invention allows a user to open and close the door of the washing machine without having to bend down and also allows laundry in the rotary drum to be sighted more easily without enlarging the inner dimension of the housing. Therefore, it is highly unlikely that the user would fail to spot and take out laundry from the rotary drum so that a more convenient washing machine can be realized. Further, the present invention can also be applied to a drum type washing and drying machine having a drying function.

While the invention has been shown and described with respect to the preferred embodiments, it will be understood by those skilled in the art that various changes and modifications may be made without departing from the spirit and scope of the invention as defined in the following claims.

What is claimed is:

1. A drum type washing machine comprising:

a housing;

a rotary drum having a rotational axis declined toward a rear portion of the housing;

a water tub elastically supported in the housing and accommodating the rotary drum therein;

a door installed at a front portion of the housing, for opening and closing a housing opening for allowing laundry to be loaded into or unloaded from the rotary drum therethrough;

a water tub opening formed at the water tub and communicating with the housing opening;

a rotary drum opening formed at the rotary drum and communicating with the housing opening and the water tub opening; and an elastic connection member for connecting the housing opening and water tub opening, and having a portion that makes a pressurized contact with the door when the door is closed, wherein a center of the housing opening is displaced upward with respect to a center of the rotary drum opening, and an angle of inclination of the housing opening with respect to a vertical plane is set to be greater than that of the rotary drum opening with respect to the vertical plane, and wherein the door includes an outer body and an inner body disposed outside and inside of the housing, respectively, an angle of inclination of the outer body with respect to the vertical plane is set to be substantially identical to that of the housing opening with respect to the vertical plane, and the inner body has a substantially flat surface positioned inside the housing, an angle of inclination of the flat surface with respect to the vertical plane being set to be substantially identical to that of the rotary drum opening with respect to the vertical plane.

2. The washing machine of claim 1, wherein an angle of inclination of the water tub opening with respect to the vertical plane is substantially identical to that of the housing opening with respect to the vertical plane.

* * * * *